US006938764B2

(12) United States Patent
Edwards et al.

(10) Patent No.: US 6,938,764 B2
(45) Date of Patent: Sep. 6, 2005

(54) PACKAGING AND SHIPPING ARRANGEMENT FOR A THREE-PIECE SHOWER AND TUB SURROUND

(75) Inventors: Michael Edwards, Blue Mountain, MS (US); Charles M. Brown, Jackson, TN (US); Darrell John Hanson, Crestwood, KY (US)

(73) Assignee: Aqua Glass Corporation, Adamsville, TN (US)

( * ) Notice: Subject to any disclaimer, the term of this patent is extended or adjusted under 35 U.S.C. 154(b) by 114 days.

(21) Appl. No.: 10/261,173

(22) Filed: Sep. 30, 2002

(65) Prior Publication Data

US 2004/0060836 A1 Apr. 1, 2004

(51) Int. Cl.[7] ..... B65D 85/00; B65D 81/06

(52) U.S. Cl. ..... 206/320; 206/593; 206/486; 206/523

(58) Field of Search ..... 206/523, 486, 206/593, 820, 320; 4/584, 610, 583, 612, 614, 559

(56) References Cited

U.S. PATENT DOCUMENTS 3,486,612 A * 12/1969 Kivell ..... 206/320
3,616,986 A * 11/1971 Wolfe et al. ..... 206/320
3,773,171 A * 11/1973 Edsall ..... 206/320
3,996,703 A 12/1976 Daniels
5,765,685 A 6/1998 Roosa
5,862,911 A * 1/1999 Phillips et al. ..... 206/320

FOREIGN PATENT DOCUMENTS

GB 2229416 A * 9/1990 ..... B65D/81/06

OTHER PUBLICATIONS

Clearview Packing, Aqua Glass Corporation, Highway 22 North, Adamsville, TN. The ribbin cuttin ceremony.
European Search Report, Oct. 26, 2004.

* cited by examiner

*Primary Examiner*—Jila M. Mohandesi
(74) *Attorney, Agent, or Firm*—Carlson, Gaskey & Olds

(57) ABSTRACT

A packaging arrangement provides a top packaging panel and a bottom packaging panel which receives a tub portion and a first and a second wall portion of a tub and surround. The packaging arrangement provides a compact transportable unit which readily fits within a rather compact package. The packaging panels are preferably manufacture of Styrofoam or the like to absorb shock and protect the tub portion and wall portions. A tub slot is substantially U-shaped to receive a tub end. That is, tub slot receives the tub portion in a substantially vertical orientation in which the tub portion stands on end and is restrained between the panels. The first wall portion slot and the second wall portion slot are substantially L-shaped and are nested to form a larger U-shape within which the tub slot is arranged. That is, the tub slot forms an inverted U relative the orientation of the larger U-shape formed by the first and second wall portion slot. When the tub portion is nested within the wall portions between the panels a rigid yet compact packaging arrangement is provided.

12 Claims, 3 Drawing Sheets

PACKAGING AND SHIPPING ARRANGEMENT FOR A THREE-PIECE SHOWER AND TUB SURROUND

BACKGROUND OF THE INVENTION

The present invention relates to a shower and tub surround, and more particularly to a packaging and shipping arrangement therefore.

Tub surrounds are positioned within a recess built around a bathtub or shower. The whole structure is inserted into the wall recess to form a completely waterproof surround. The fully enclosed waterproof structure is highly advantageous in that it prevents the escape of water into the wall cavity despite the shower spraying water onto the surrounding walls.

One problem which has always arisen with products of this type is that of transporting the assembly. Transportation may be particularly difficult for a homeowner who desires to install the tub surround as a home improvement project. Typically, the tub is formed separate from a one or two piece U-shaped wall surround portion. The contiguous wall portion fits atop the tub to provide ease of assembly while assuring a waterproof surround.

The tub and wall surround are relatively large products that must be assembled for transportation. The size of an assembled unit makes it extremely difficult to transport in a family vehicle such as a Sport Utility Vehicle or minivan. A consumer may therefore be dissuaded from purchasing a tub and wall surround as a "do-it-yourself" home improvement project.

Additionally, these units are extremely space intensive making it both expensive to ship and difficult to handle at the plumbing wholesale and retail sales site. Retailers particularly, have difficulties dedicating sufficient bin space thus, often limiting the retailer's ability to maintain and sell adequate stock.

SUMMARY OF THE INVENTION

The packaging arrangement according to the present invention provides a top packaging panel and a bottom packaging panel which receives a tub portion and a first and a second wall portion of a tub and surround. The packaging arrangement provides a compact transportable unit which readily fits within a rather compact box. By receiving the tub and surround structure within a rectilinear package, the packaging arrangement protects the tub and surround structure for transportation and storage. Moreover, an extremely compact structure is provided which facilitates transportation of the tub and surround within a family vehicle.

The packaging end caps are preferably manufactured of Styrofoam or the like to absorb shock and protect the tub portion and wall portions. A tub slot is substantially U-shaped to receive the tub portion in a substantially vertical orientation in which the tub portion stands on end and is restrained between the panels. The first wall portion slot and the second wall portion slot are substantially L-shaped and are nested to form a larger U-shape within which the tub slot is arranged. That is, the tub slot forms an inverted U relative the orientation of the larger U-shape formed by the first and second wall portion slot.

The packaging panels orientate the first wall portion slot and the second wall portion slot such that the back wall portion overlap adjacent the underside of the tub portion when in the packaged position. Each end wall portion extends substantially along the side of the tub portion. When the tub portion is nested within the wall portions between the panels a rigid yet compact packaging arrangement in which the wall portions do not actually touch each other when packaged between the panels.

The present invention therefore provides a tub and wall surround which facilitates (a) convenient transportation in a family sized vehicle (b) half the cost to ship and (c) less space intensive for the wholesale plumber or retail store to store and display.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows:

FIG. 2 is a perspective view of the tub and wall surround packaging arrangement;

DETAILED DESCRIPTION OF THE PREFERRED EMBODIMENT

Figure 1:
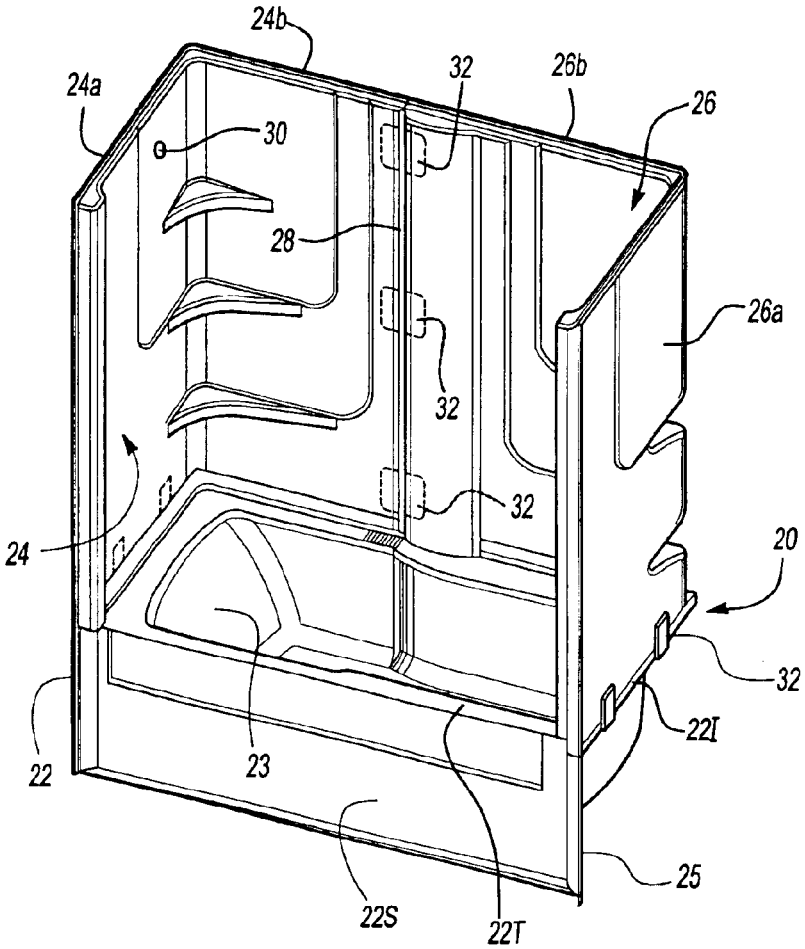
FIG. 1 is a perspective view of a tub and shower surround in an assembled condition.

FIG. 1 illustrates a general perspective view of a molded tub and surround 20 which is formed of three pieces of molded plastic. In particular, a tub portion 22 receives wall portions 24 and 26 to form the combined tub and surround 20. The tub portion 22 defines a bowl 23 about which a flange 25 extends therefrom. The flange 25 defines a substantially L-shape at each lateral end 22*l* formed by the top 22*t* and visible side 22*s*. It should be understood that the term "tub" encompasses shower bases and other bath lower portions.

A joint 28 is defined between the wall portions 24 and 26. A shower head 30 is preferably mounted within the wall 24 such that water will move in the direction of left to right in FIG. 1. A plurality of clamps 32 are spaced vertically along the joint 28.

Each wall portion 24, 26 is a substantially L-shaped component. That is, wall portions 24, 26 each consists of an end wall portion 24*a*, 26*a* substantially perpendicular to a back wall portion 24*b*, 26*b*. The end wall portion 24*a*, 26*a* extend along the lateral ends 22*l* of the tub surround 20 while each back wall portion 24*b*, 26*b* extends approximately halfway along the longitudinal length of the tub portion 22.

Figure 2:
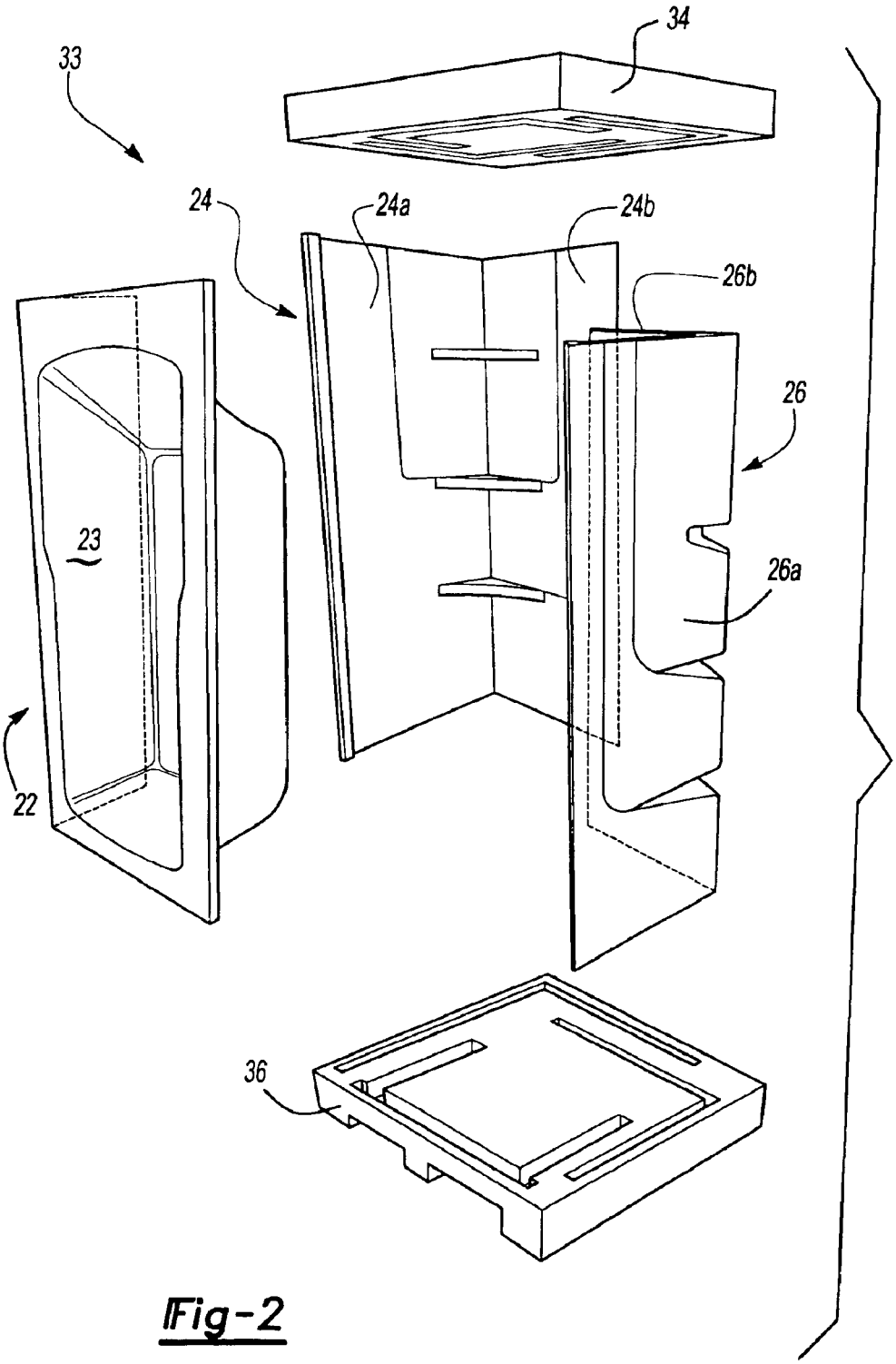
FIG. 2 is a general view of the tub and wall surround arrangement.

Referring to FIG. 2, an exploded view of a packaging arrangement 33 is illustrated in an exploded view. A top packaging panel 34 and a bottom packaging panel 36 (also illustrated in FIG. 3) receives the tub portion 22 and wall portions 24 and 26 to provide a compact transportable unit which readily fits within a box 38 or the like. By receiving the tub and surround 20 structure and being readily fitted within a rectilinear box 38, the packaging arrangement 33 protects the tub and surround 20 structure for transportation and storage. Moreover, an extremely compact structure is provided which facilitates transportation of the tub and surround 20 within a family vehicle.

Figure 3:
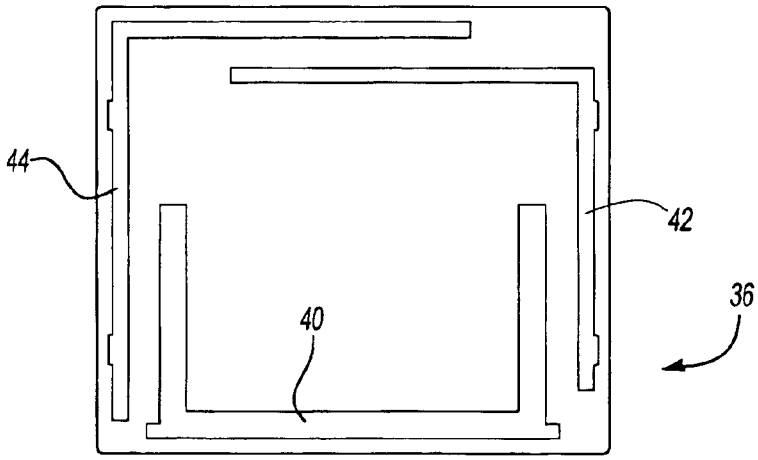
FIG. 3 is an expanded view of a packaging panel.

Referring to FIG. 3, the packaging panel 34, 36 is illustrated. The panels 34, 36 are preferably manufacture of Styrofoam or the like to absorb shock and protect the tub portion 22 and wall portions 24 and 26. The panels 34, 36 each include a tub slot 40, a first wall portion slot 42 and a second wall portion slot 44. The slots 40, 42, 44 are preferably shaped to receive the tub and surround with a friction fit. It should be understood that although only panel 36 is described in the illustrative embodiment panel 34 will include similar features which receive the opposite end of the tub and shower surround 20.

The tub slot 40 is preferably U-shaped even though only a portion of the tub slot 40 is utilized. That is, the flange 25 defines an L-shape by the formed by the top 22*t* and visible side 22*s* (FIG. 1). Depending upon which end of the tub portion 22 is placed into the panel 34, 36 only one side of the U shaped tub slot 40 receives the visible side 22*s* of the flange (FIG. 1). Packaging for the workers is therefore simplified.

Figure 4:
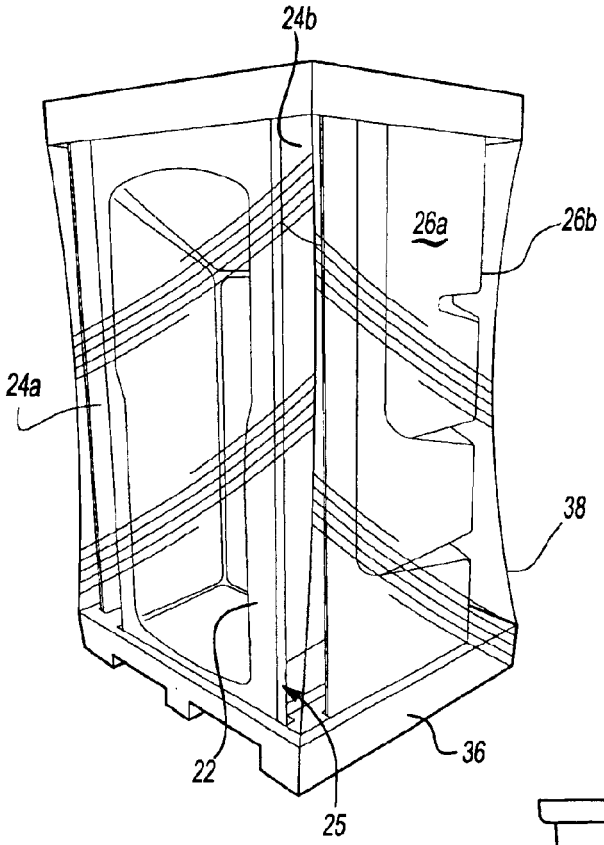
FIG. 4 is a perspective view of the tub and wall surround as located within the packaging panel.

The tub slot 40 is substantially U-shaped to receive the tub flange 25 (FIG. 2). That is, tub slot 40 receives the tub portion 22 in a substantially vertical orientation in which the tub portion 22 stands on end and is restrained between the panels 34, 36 (FIG. 4). The first wall portion slot 42 and the second wall portion slot 44 are substantially L-shaped and are nested to form a larger U-shape within which the tub slot 40 is arranged. That is, the tub slot 40 forms an inverted U relative to the orientation of the larger U-shape formed by the first and second wall portion slot 42, 44. The slots 42, 44 preferably include end segments which closely receive the molded end portions of panels 24, 26.

Each packaging panel 34, 36 orientates the first wall portion slot 42 and the second wall portion slot 44 such that the back wall portion 24*b*, 26*b* overlap adjacent the underside of the tub portion 22 when in the packaged position (FIG. 4). Each end wall portion 24*a*, 26*a* extends substantially along the side of the tub portion 40. That is, the bowl 23 of the tub portion 22 is essentially cradled between the wall portions 24, 26. When the tub portion 22 is nested within the wall portions 24, 26 between the panels 34, 36 a rigid yet compact packaging arrangement is provided. It should be understood that the tub portion 22 and the wall portions 24, 26 do not actually touch each other when mounted between the panels 34, 36.

Figure 5:
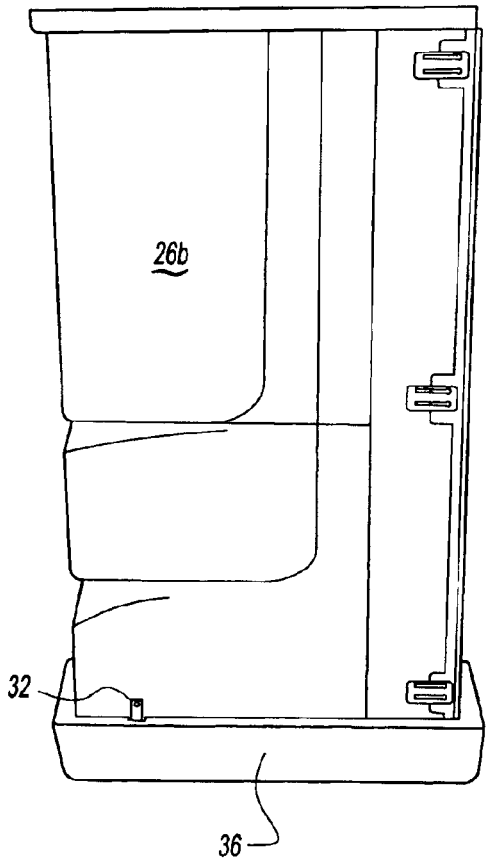
FIG. 5 is a rear view of the tub and wall surround as located within one packaging panel.

Referring to FIG. 5, the clamps 32 which secure the panels 24, 26 to the tub portion 22 preferably penetrate into the panels 34, 36 to further increase the rigidity of the packaged structure.

The entire tub and surround 20 is then covered with a protective plastic sheet and inserted into the end cap and shrink wrapped with Clear View packaging. It should be understood that other protective measures such as the insertion of support blocks between the tub portion 20 and the wall portions 24, 26 will also benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A packaging arrangement for a tub surround comprising:

a first packaging panel comprising a U-shaped tub slot to receive one end of a tub portion, a first L-shaped wall slot to receive one end of a first wall portion, and a second L-shaped wall slot to receive one end of a second wall portion; and a second packaging panel comprising a U-shaped nab slot to receive an opposite end of the tub portion, a first L-shaped wall slot to receive an opposite end of the first wall portion, and a second L-shaped wall slot to receive an opposite end of the second wall portion such that the tub portion, first wall portion and the second wall portion fit between said first and second packaging panel.

2. The packaging arrangement as recited in claim 1, wherein said first and a second L-shaped slot form a U-shape.

3. The packaging arrangement as recited in claim 2, wherein said U-shaped tub slot is arranged inverted and within the U-shape formed by said first and second L-shaped slot.

4. The packaging arrangement as recited in claim 1, wherein only a portion of said U-shaped tub slot receives a flange of the tub portion.

5. The packaging arrangement as recited in claim 1, wherein said first and second packaging panel prevent contact between the tub portion, the first wall portion and the second wall portion when fined between said first and second packaging panel.

6. The packaging arrangement as recited in claim 1, wherein a bottom of a bowl of the tub portion faces a back wall portion of the first wall portion and a back wall portion of the second wall portion when fitted between said first and second packaging panel.

7. A packaged tub surround comprising:

a tub portion;

a first L-shaped wall portion comprising a first end wall and a first back wall;

a second L-shaped wall portion comprising a second end wall and a second back wall;

a first packaging panel comprising a U-shaped tub slot to receive one end of said tub portion, a first L-shaped wall slot to receive one end of said first L-shaped wall portion, and a second L-shaped wall slot to receive one end of said second L-shaped wall portion; and a second packaging panel comprising a U-shaped tub slot to receive an opposite end of the tub portion, a first L-shaped wall slot to receive an opposite end of the first L-shaped wall portion, and a second L-shaped wall slot to receive an opposite end of the second L-shaped wall portion such that said tub portion, said first wall portion and said second wall portion fit between said first and second packaging panel.

8. The packaging arrangement as recited in claim 7, wherein a bottom of a bowl of the cub portion faces a back wall portion of the first wall portion and a back wall portion of the second wall portion when fitted between said first and second packaging panel.

9. The packaging arrangement as recited in claim 7, wherein said first and second end wall are parallel when fitted between said first and second packaging panel.

10. The packaging arrangement as recited in claim 7, wherein said first and second back wall are parallel when fitted between said first and second packaging panel.

11. The packaging arrangement as recited in claim 7, wherein said first and second wall portions form a U-shape when fitted between said first and second packaging panel.

12. The packaging arrangement as recited in claim 11, wherein a flange of said tub portion fits within said U-shape.

* * * * *

UNITED STATES PATENT AND TRADEMARK OFFICE

CERTIFICATE OF CORRECTION

PATENT NO. : 6,938,764 B2
DATED : September 6, 2005
INVENTOR(S) : Edwards et al.

It is certified that error appears in the above-identified patent and that said Letters Patent is hereby corrected as shown below:

Column 4,
Line 3, “nab” should be -- tub --.
Line 24, “fined” should be -- fitted --.
Line 52, “cub” should be -- tub --.

Signed and Sealed this

Twenty-ninth Day of November, 2005

JON W. DUDAS
*Director of the United States Patent and Trademark Office*